US005382111A

United States Patent [19]

Melashenko et al.

[11] Patent Number: 5,382,111

[45] Date of Patent: Jan. 17, 1995

[54] HINGED FRAME STRUCTURE

[76] Inventors: Robert A. Melashenko; Connie R. Melashenko, both of 1673 Dwight St., Redlands, Calif. 92373

[21] Appl. No.: 901,811

[22] Filed: Jun. 22, 1992

[51] Int. Cl.[6] ..... E04H 17/00; F16C 11/00

[52] U.S. Cl. ..... 403/329; 403/326; 403/79; 403/161; 403/119; 256/26; 256/65

[58] Field of Search ..... 446/476, 478, 479; 403/91, 113, 66, 119, 161, 329, 326, 330, 79; 256/25, 26, 24, 65; 285/256, 382, 382.1, 382.7, 382.4; 5/99.1, 93.1, 93.2

[56] References Cited

U.S. PATENT DOCUMENTS

| | | | |
|---|---|---|---|
| 1,030,527 | 6/1912 | Nelson | 403/79 |
| 1,569,311 | 1/1926 | Barstow | 403/79 |
| 3,247,628 | 4/1966 | Miller . | |
| 4,001,987 | 1/1977 | Coulthard . | |
| 4,645,183 | 2/1987 | Rattray | 256/25 |
| 4,669,138 | 6/1987 | Kassai | 5/99.1 |
| 4,711,595 | 12/1987 | Magid | 403/329 |
| 4,712,773 | 12/1987 | Larson | 256/25 |
| 4,884,988 | 12/1989 | McMurray . | |
| 4,929,113 | 5/1990 | Sheu | 403/91 |

*Primary Examiner*—Randolph A. Reese
*Assistant Examiner*—Anthony Knight
*Attorney, Agent, or Firm*—Dorsey & Whitney

[57] ABSTRACT

A children's play structure includes a hinged frame structure having mounted thereon a plurality of panels depicting murals or scenes. The hinged frame structure which is comprised of a plurality of hinging sections and which is of lightweight, simple and economical construction is provided with substantial rigidity by corner structures which include hinging apparatus at the upper and lower ends of vertical tubes to permit pivoting rotation of the corner structure relative to one but not the other of a pair of frame sections coupled thereby. Each of the upper and lower hinging apparatus includes a clevis and a lever releasably coupled to the horizontal tubes of the adjacent frame sections by plugs with resilient release tabs. The clevis and lever have interleaved legs which receive a shaft and an opposite cap within apertures therein to permit pivoting rotation between the lever and the clevis while at the same time providing substantial resistance to unwanted vertical flexure. At the same time, the shaft which is secured to the vertical tube of the corner assembly, and the cap which is non-rotatably coupled thereto, are prevented from rotating relative to the clevis, such that only one of the adjacent hinging frame sections is free to rotate relative to the single common vertical tube of the corner structure. The front sections at opposite ends of the hinged frame structure have upper and lower tubes which terminate at vertical tubes to which such upper and lower tubes are coupled by elbows.

13 Claims, 5 Drawing Sheets

HINGED FRAME STRUCTURE

BACKGROUND OF THE INVENTION

1. Field of the Invention

The present invention relates to free-standing hinged frame structures, and more particularly to a free-standing frame structure comprised of hinging sections for mounting panels having murals or scenes thereon to provide a children's play structure.

2. History of the Prior Art

It is known to provide a children's play structure comprised of a free-standing frame with rectangular hinging sections arranged to form an enclosure and mounting one or more panels having murals or scenes thereon. Such arrangements are described, for example, in a co-pending application of Connie R. Melashenko et al., "Children's Play Structure With Interchangeable Scenes", Ser. No. 07/697,081, filed May 8, 1991, now abandoned. The Melashenko et al. application describes different embodiments of a children's play structure in which a free-standing frame comprised of hinging sections has one or more panels mounted thereon. The panels are provided with murals or scenes so as to create a desired environment for children's play. The environment or theme provided by the structure may be, for example, that of a school classroom, a doctor's office, a store, a spaceship or the like. The scenes or murals depict enough to suggest the desired theme or environment, while at the same time allowing the child to use his or her imagination with respect to some of the details. The child is thus able to act out various activities and sequences of events using the play structure as a prop.

The Melashenko et al. application describes an embodiment of a play structure comprised of hinging frame sections which include a back, opposite sides and a pair of front sections. The front sections can act as doors and serve to provide access to the interior of the structure. The hinging frame sections are of flat, rectangular configuration and are comprised of an open frame of elongated beams joined at the corners. Such open frame sections are hingedly coupled to adjacent frame sections by various different hinging apparatus. For example, conventional hinges are used in one embodiment. In another embodiment, the adjacent vertical portions of the joined frame sections include a hinging corner post arrangement comprised of a dowel disposed within and rotatable relative to a hollow tube. The dowel is secured to the upper and lower horizontal beams of one frame section. The hollow tube is secured to the upper and lower horizontal beams of the adjoining frame section. Brackets which are coupled to the horizontal beams are pivotable relative to each other and support the dowel and hollow tube for rotational movement of the dowel within the hollow tube.

The hinged frame structures described in the Melashenko et al. application fulfill the need for transportability and storability of such structures. In addition to being of relatively simple, lightweight construction, such structures fold and/or disassemble to facilitate transport and storage thereof.

However, the various frame structures described in the Melashenko et al. application leave room for improvement, particularly from the standpoint of providing a frame structure of adequate rigidity when erected for use. Those frame structures which are of particularly simple and lightweight construction in their design tend to lack the desired rigidity so as to be prone to collapsing, particularly when relatively heavy panels are placed thereon or when subjected to external forces. Still other designs which may have greater rigidity and resistance to collapse may be too heavy or cumbersome or complex to be practical or economical. Also, the frame sections may be difficult to assemble for use and to disassemble for storage or transport.

It is therefore an object of the present invention to provide an improved hinged frame structure.

A further object of the present invention is the provision of a hinged frame structure having sufficient rigidity to be able to stand alone and to support murals mounted thereon, without substantial danger of collapse, and while at the same time providing a relatively lightweight, simple and economical structure which is easily assembled and disassembled.

BRIEF DESCRIPTION OF THE INVENTION

The present invention provides hinged frame structures of relatively lightweight, simple and economical construction, and which at the same time are relatively rigid and capable of supporting a substantial amount of weight placed thereon and of resisting external forces applied thereto. Such structures are comprised of a plurality of hinging sections of flat, rectangular and generally open construction. Adjacent frame sections are joined for relative hinging movement by a corner structure utilizing a single corner post or other beam-like vertical member. The upper and lower beams of adjacent frame sections are coupled to the common corner post by hinging apparatus which fixedly couples the corner post to one frame section while permitting hinging movement of the adjacent frame section relative to the corner post. By designing the corner structure so that only one of the frame sections joined thereby is pivotable relative to the corner post and so that the upper and lower beams of adjacent frame sections couple to the corner post in a manner which prevents excessive vertical flexibility, the free-standing structure is provided with the necessary strength and rigidity to be both free-standing and to support the weight of panels or other devices when opened into a variety of different configurations.

In a preferred embodiment of a hinged frame structure according to the invention, adjacent frame sections are joined by a corner structure comprised of hinging apparatus at upper and lower ends of a common corner post. The upper and lower hinging apparatuses each include a clevis removably coupled via a plug to a tube comprising one of the horizontal beams of one hinging section, and a lever removably coupled by a plug to a tube comprising one of the horizontal beams of the adjacent frame section. The clevis and the lever of each hinging apparatus are rotatably joined by a shaft extending through apertures in interleaved legs of the clevis and the lever. This permits pivoting movement of the lever relative to the clevis and the shaft while at the same time minimizing vertical flexure of both the lever and the clevis relative to the shaft. An opposite cap is joined to the shaft by an internal screw to hold the hinging apparatus together. The shaft is secured within one of the opposite upper and lower ends of the corner post. The shaft and the cap are secured against rotation within the clevis, thereby preventing rotation of the corner post relative to the upper and lower tubes of one of the frame sections. At the same time, the levers are freely rotatable relative to the clevises as well as to the shafts and caps so as to permit rotational movement of the adjacent frame section relative to the corner post.

The plugs employed to couple the horizontal tubes at the upper and lower portions of the frame sections to the clevis and the lever and which are rigidly secured within the tubes such as by gluing are releasable from the clevis and the lever by manual depression of a resilient retainer formed as part of the plug. The resilient retainer has a tab at the extremity thereof which seats within a mating aperture in the clevis or the lever when the plug is inserted therein, to prevent removal of the plug. Manual depression of the tab flexes the resilient retainer until the tab is free of the aperture, at which point the plug can be removed from the clevis or the lever. This greatly facilitates assembly and disassembly of the frame sections.

In one example of a hinged frame structure employing corner structures of the type described at the interfaces between adjacent hinging sections, a rectangular back frame section which has upper and lower horizontal tubes coupled to opposite corner structures thereof is pivotally coupled to opposite rectangular side frame sections having upper and lower tubes coupled to the corner structures of the back frame section. The horizontal tubes of the side frame sections are also coupled to corner structures which pivotally couple the side frame sections to a pair of rectangular front frame sections. Such corner structures are coupled to horizontal tubes within the front frame sections. The configuration of the corner structures, including the hardware used to join the opposite horizontal tubes and the ability of the horizontal tubes on only one side of the common corner post to pivot relative thereto, provide the resulting hinged frame structure with substantial rigidity when erected into a variety of different configurations.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
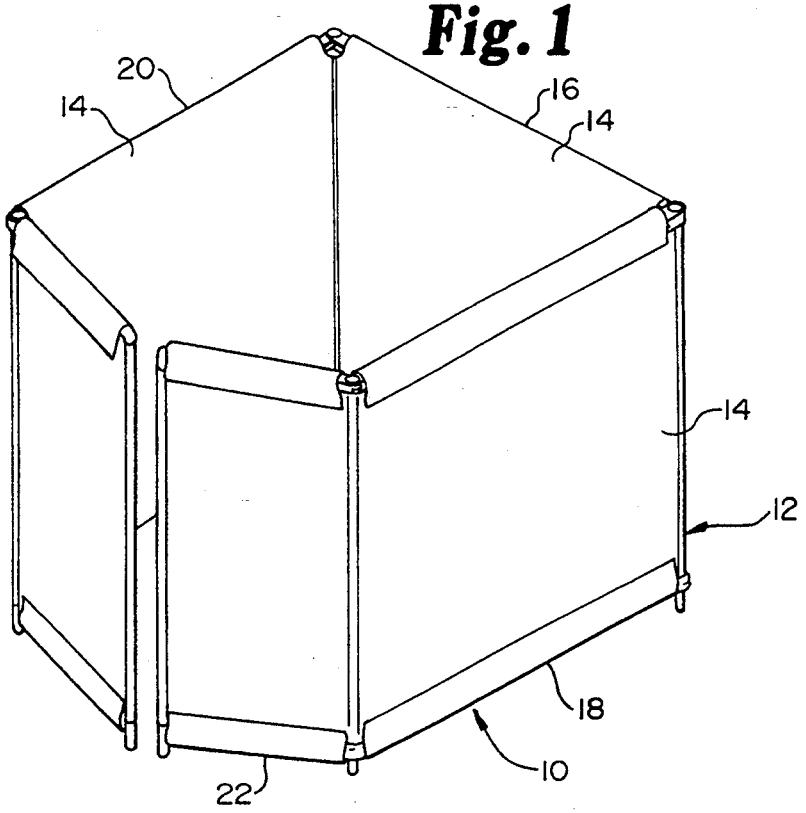
FIG. 1 is a perspective view of a children's play structure employing a hinged frame structure according to the invention.

FIG. 1 shows a free-standing structure in the form of a children's play structure 10 employing a hinged frame structure 12 in accordance with the invention. In addition to the hinged frame structure 12, the children's play structure 10 includes a plurality of panels 14 mounted on different sections of the hinged frame structure 12. Each panel 14 is provided with a mural or scene on one or both sides thereof, to provide the children's play structure 10 with a desired theme or environment.

As shown in FIG. 1, the hinged frame structure 12 is comprised of a plurality of hinging frame sections, which include a back section 16, opposite side sections 18 and 20, and a pair of front sections 22 and 24 hingingly coupled to the side sections 18 and 20, respectively. While the hinged frame structure 12 can be arranged into any desired configuration, typically such structure is arranged to form an enclosure in which the front sections 22 and 24 may be used as doors and otherwise serve to enclose the structure. In this manner, the enclosed structure formed by the hinged frame structure 12 can simulate a room or other enclosed space.

Figure 2:
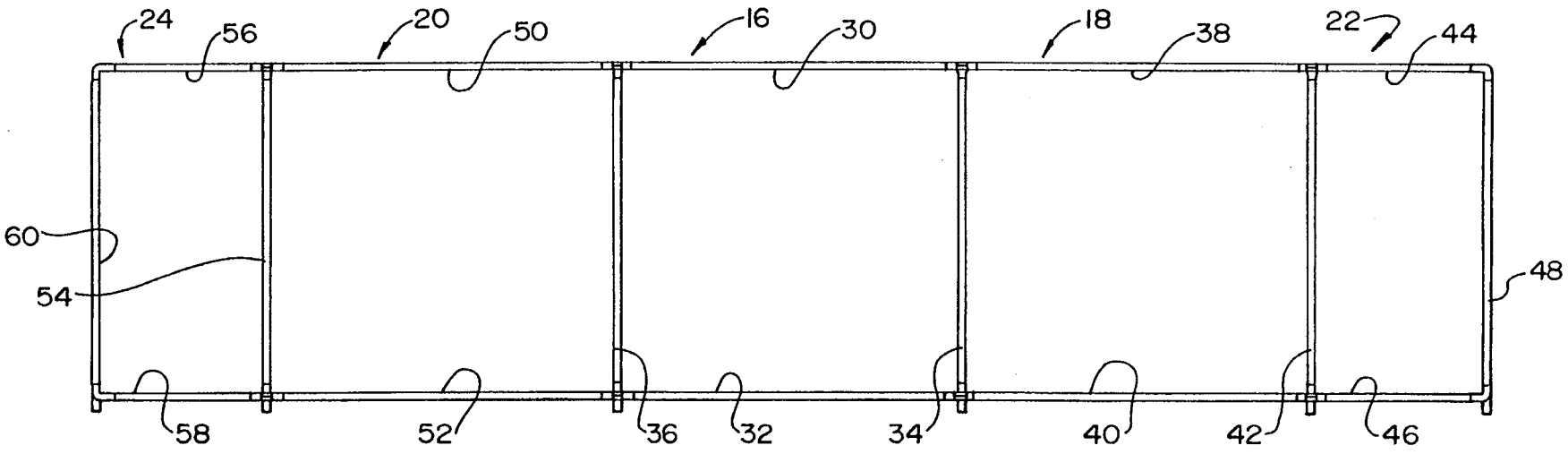
FIG. 2 is an elevation view of the hinged frame structure of the children's play structure of FIG. 1 which has been opened to assume a linear configuration and to illustrate the various hinging frame sections thereof.

FIG. 2 is an elevational view of the hinged frame structure 12 which has been opened to assume a linear configuration and illustrating the various different hinging sections. As shown in FIG. 2 the center portion thereof forms the back section 16 which is hingingly coupled at opposite ends thereof to the opposite side sections 18 and 20. The side section 18 is hingingly coupled to the front section 22. Similarly, the side section 20 is hingingly coupled to the front section 24. Each of the frame sections 16, 18, 20, 22 and 24 is rectangular in shape and is of thin, planar, open construction. The back section 16 is comprised of upper and lower tubes 30 and 32 forming horizontal beams for the section 16. The tubes 30 and 32 are joined at their opposite ends to corner structures 34 and 36 forming the opposite ends of the back section 16.

The corner structure 34 of the back section 16 is shared by and forms one end of the side section 18 which has upper and lower tubes 38 and 40 forming the upper and lower horizontal beams thereof. The opposite end of the side section 18 is formed by a corner structure 42. The corner structure 42 also forms one end of the front section 22 which has upper and lower tubes 44 and 46 forming the horizontal beams thereof and extending between the corner structure 42 and a vertical tube 48 at the opposite end of the front section 22.

The corner structure 36 of the back section 16 is shared by and forms one end of the side section 20 which has horizontal beams comprised of an upper tube 50 and a lower tube 52. The opposite end of the side section 20 is formed by a corner structure 54. The corner structure 54 also forms one end of the front section 24 which has upper and lower tubes 56 and 58 forming the horizontal beams thereof. The upper and lower tubes 56 and 58 extend from the corner structure 54 to a vertical tube 60 at the opposite end of the front section 24.

Figure 3:
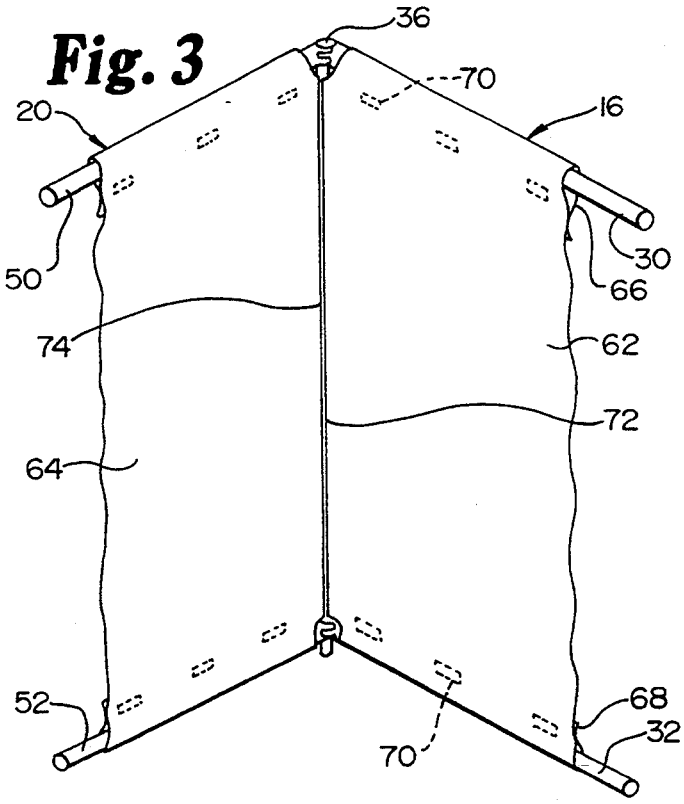
FIG. 3 is a perspective view of a portion of the children's play structure of FIG. 1, showing the manner in which panels are mounted on adjacent frame sections of the hinged frame structure.
Figure 4:
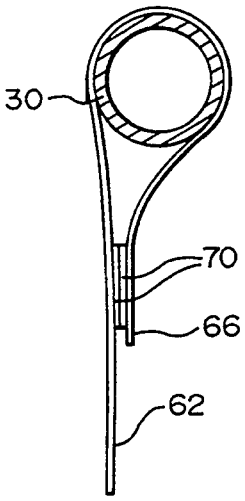
FIG. 4 is a sectional view of one of the horizontal tubes and a portion of an associated panel of the arrangement of FIG. 3, showing the manner in which the panel is removably mounted.

The manner in which the panels 14 are mounted on the various sections of the hinged frame structure 12 is shown in FIGS. 3 and 4. FIG. 3 shows the adjoining portions of the back section 16 and the side section 20 which are joined by the corner structure 36. A panel 62 is mounted on the back section 16, while a panel 64 is mounted on the side section 20. The height of the panel 62 is greater than the distance between the upper and lower tubes 30 and 32 so that opposite upper and lower ends 66 and 68 of the panel 62 may be looped over and around the upper and lower tubes 30 and 32. The upper end 66 is secured to the panel 62 by opposing pairs of Velcro patches 70 which are shown in dotted outline in FIG. 3. FIG. 4 shows one of the opposing pairs of the Velcro patches 70 as they are used to join the panel 62 to itself after looping over the upper tube 30. The lower end 68 of the panel 62 is wrapped around the lower tube 32 and secured to itself by opposing pairs of the Velcro patches 70, in similar fashion. The upper and lower ends of the panel 64 are secured to the upper and lower tubes 50 and 52 of the side section 20, in similar fashion.

In the present example, the panels 14 such as the panels 62 and 64 are made of plastic sheeting which has desired murals or scenes printed thereon. The murals or scenes can be printed on one side only or on both sides of the panels 14, as desired. As shown in FIG. 3, the upper and lower corners of the panels 14 are cut back so as to fit around the upper and lower ends of the corner structures such as the structure 36. This permits the side edges, such as edges 72 and 74 of the panels 62 and 64, to abut one another and thereby cover essentially all of the corner structure 36.

When erecting the children's play structure 10, the hinged frame structure 12 is first placed in a desired position such as that shown in FIG. 1. The various panels 14 are then mounted on the sections of the hinged frame structure 12 using the opposing pairs of Velcro patches 70, in the manner previously described. With the panels 14 mounted on the hinged frame structure 12 in this manner, the murals or scenes on the panels 14 create the desired environment or theme of the children's play structure 10. Disassembly of the children's play structure 10 is initiated by separating the opposing pairs of Velcro patches 70 and removing the panels 14 from the hinged frame structure 12. Thereafter, the hinged frame structure 12 can be disassembled or folded.

Figure 5:
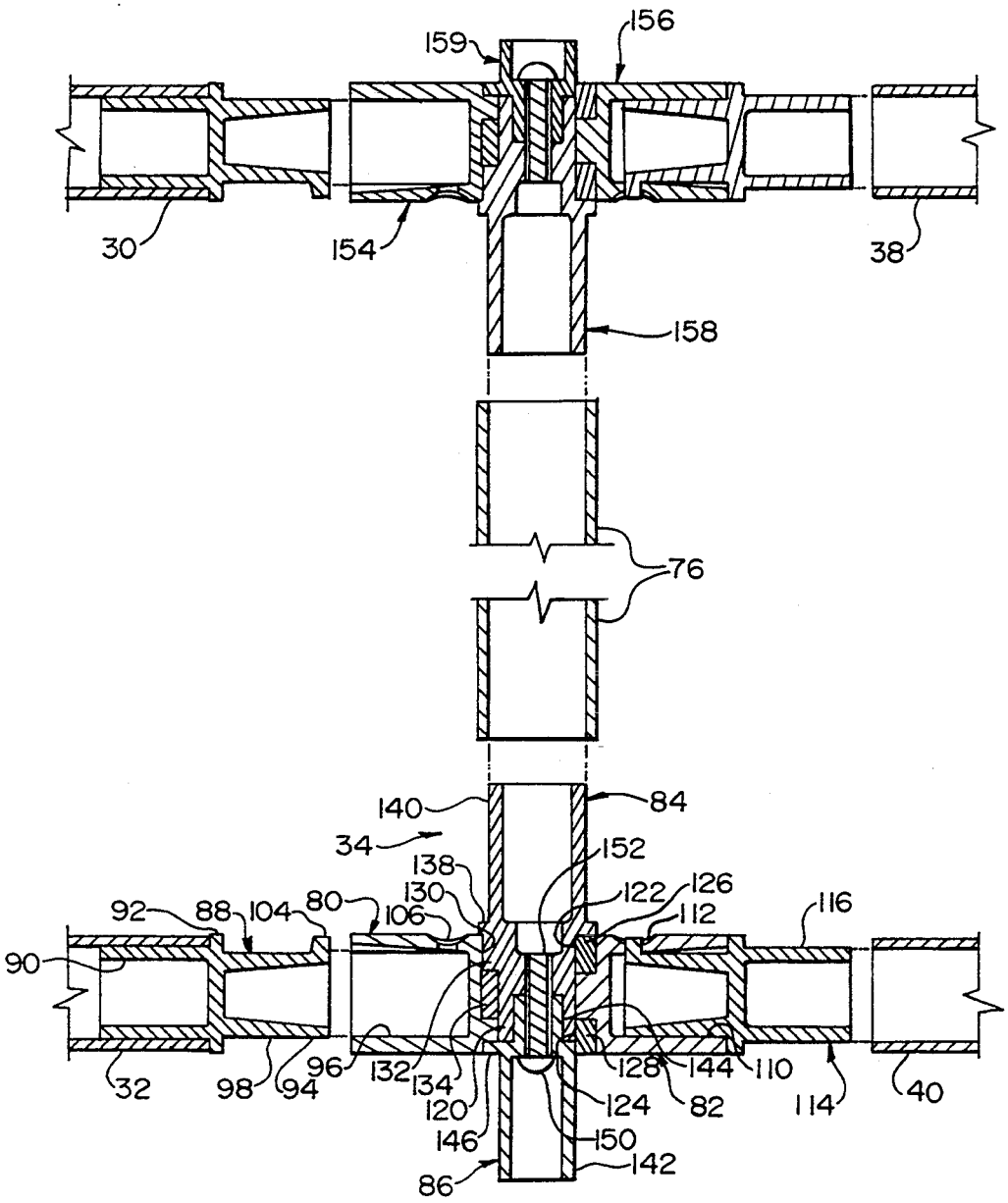
FIG. 5 is a sectional view of a corner structure of the hinged frame structure of FIG. 2, showing the details of hinging apparatus for pivotally joining adjacent frame sections.

As previously described in connection with FIG. 2, the various sections 16, 18, 20, 22 and 24 of the hinged frame structure 12 are joined by the corner structures 34, 36, 42 and 54. The corner structures 34, 36, 42 and 54 are of like construction, and each includes pivoting apparatus at the opposite upper and lower ends thereof which is of like configuration. Exemplary of such pivoting apparatus is the apparatus shown in FIG. 5. The apparatus shown in FIG. 5 represents the corner structure 34 which joins the upper tubes 30 and 38 and the lower tubes 32 and 40 of the back section 16 and the side section 18. The corner structure 34 includes a single common corner post in the form of a vertical tube 76 extending between the upper and lower ends of the corner structure 34.

The lower portion of the corner structure 34 shown in FIG. 5 includes a clevis 80 which is pivotably coupled to a lever 82 by a shaft 84 and an opposite cap 86. The clevis 80 is removably coupled to the lower tube 32 by a plug 88 having a first cylindrical end 90 thereof disposed within the hollow interior of the lower tube 32 and secured in place therein such as by gluing. The cylindrical end 90 terminates at a flange 92 which is seated against the outer end of the lower tube 32. An end 94 of the plug 88 on the opposite side of the flange 92 from the cylindrical end 90 is of slightly tapered configuration so as to be slidably received within a slightly tapered hollow interior 96 of the clevis 80.

Figure 7:
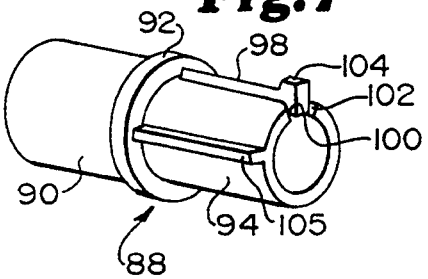
FIG. 7 is a perspective view of a plug used to releasably join the horizontal tubes in the arrangements of FIGS. 5 and 6.
Figure 8:
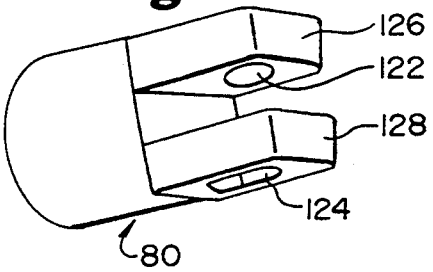
FIG. 8 is a perspective view of a clevis used in the arrangement of FIG. 5.

As shown in FIG. 7, which is a perspective view of the plug 88, the tapered end 94 includes a resilient retainer 98 separated by opposite slots 100 and 102 from the main portion of the tapered end 94. The resilient retainer 98, which extends longitudinally along the tapered end 94 from the flange 92, terminates in a tab 104. The tapered end 94 also includes a longitudinal flange 105 along a portion thereof removed by approximately 90° from the location of the resilient retainer 98.

Figure 11:
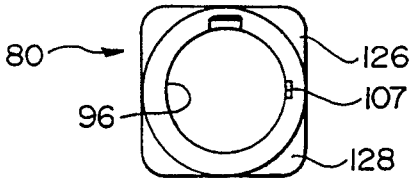
FIG. 11 is an end view of the clevis of FIG. 8.

Insertion of the tapered end 94 of the plug 88 into the hollow interior 96 of the clevis 80 engages the tab 104 against a wall of the hollow interior 96 so as to compress the resilient retainer 98 inwardly. As the tapered end 94 reaches the end of the hollow interior 96 where it is to be seated, the tab 104 snaps into an aperture 106 in the wall of the clevis 80 to lock the resilient retainer 98 in such position and thereby removably secure the lower tube 32 to the clevis 80. Proper orientation of the plug 88 in the hollow interior 96 of the clevis 80 is established and thereafter maintained by the longitudinal flange 105 which is inserted into a longitudinal slot 107 in the hollow interior 96. The flange 105 and the slot 107 prevent rotation of the plug 88 within the clevis 80. The slot 107 is shown in the end view of FIG. 11.

Removal of the lower tube 32 from the corner structure 34 during disassembly of the hinged frame structure 12 is accomplished by pressing inwardly on the tab 104 at the outside of the aperture 106 to compress the resilient retainer 98 by a sufficient amount so that removal of the tapered end 94 of the plug 88 from the hollow interior 96 of the clevis 80 is initiated. Thereafter, the tab 104 slides along the surface of the hollow interior 96 as the tapered end 94 is withdrawn from the hollow interior 96.

Like the clevis 80, the lever 82 is provided with a slightly tapered hollow interior 110 having an aperture 112 in a sidewall thereof. A plug 114 having a configuration like that of the plug 88 is releasably installed in the hollow interior 110 of the lever 82 in similar fashion. The plug 114 has a cylindrical end 116 which is permanently secured to the hollow interior of the lower tube 40, such as by gluing. In this manner, the lower tube 40 is releasably secured to the lever 82.

Figure 9:
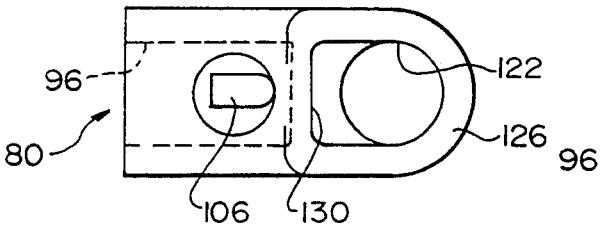
FIG. 9 is a top view of the clevis of FIG. 8.
Figure 15:
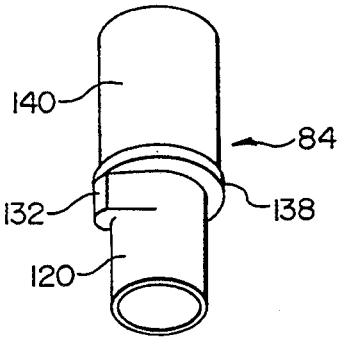
FIG. 15 is a perspective view of a shaft used in the arrangement of FIG. 5.

The lever 82 is pivotably coupled to the clevis 80 by the shaft 84 and the cap 86. The shaft 84, which is also shown in FIG. 15, has a lower portion 120 thereof of generally cylindrical configuration which extends through apertures 122 and 124 in a spaced-apart pair of legs 126 and 128 formed at one end of the clevis 80. The clevis 80 is shown in FIGS. 8–11 as well as in FIG. 5. As shown in FIGS. 5 and 9, the aperture 122 in the leg 126 has a recessed portion 130 formed within the leg 126 at one side of the aperture 122 for receiving a radial lug 132 formed at an upper end of the lower portion 120 of the shaft 84. With the lug 132 seated in the recessed portion 130, rotation of the shaft 84 relative to the clevis 80 is prevented.

Figure 12:
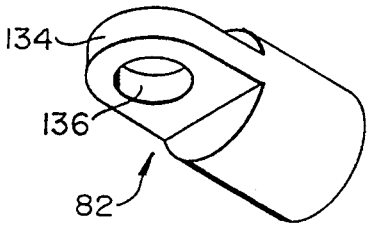
FIG. 12 is a perspective view of a lever used in the arrangement of FIG. 5.
Figure 13:
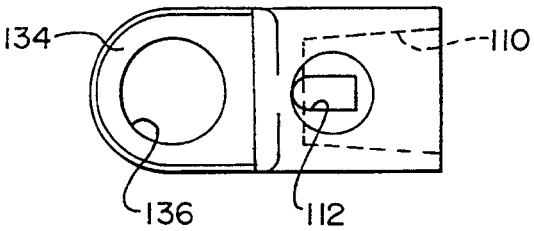
FIG. 13 is a top view of the lever of FIG. 12.
Figure 14:
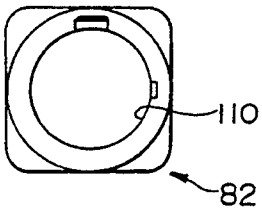
FIG. 14 is an end view of the lever of FIG. 12.

The lever 82, which is shown in FIGS. 12–14 as well as in FIG. 5, has a single leg 134 formed at one end thereof, for disposition between the opposing legs 126 and 128 of the clevis 80. An aperture 136 in the leg 134 receives the lower portion 120 of the shaft 84, to provide rotational or pivoting movement of the lever 82 relative to the clevis 80.

The lower portion 120 of the shaft 84 extends downwardly from an intermediate flange 138 which seats on the top of the clevis 80. A hollow, generally cylindrical upper portion 140 of the shaft 84 extends upwardly from the flange 138 and is received within the hollow interior of the vertical tube 76, where the upper portion 140 may be fixedly secured such as by gluing. Because the lug 132 on the lower portion 120 of the shaft 84 seats within the recessed portion 130 in the upper leg 126 of the clevis 80 to prevent rotation of the shaft 84 relative to the clevis 80, the vertical tube 76 is also fixed and cannot rotate relative to the clevis 80. However, the lever 82 which is freely rotatable about the lower portion 120 of the shaft 84 can also rotate relative to the vertical tube 76.

Figure 10:
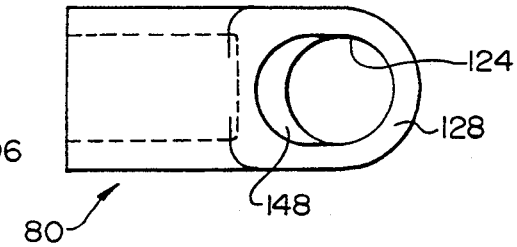
FIG. 10 is a bottom view of the clevis of FIG. 8.
Figure 16:
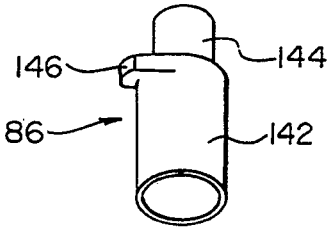
FIG. 16 is a perspective view of a cap used in the arrangement of FIG. 5.

With the lower portion 120 of the shaft 84 seated within the legs 126 and 128 of the clevis 80 and the leg 134 of the lever 82, the shaft 84 is secured in such position by the cap 86. The cap 86, which is also shown in FIG. 16, has a lower portion 142 of hollow, generally cylindrical configuration joined to an upper portion 144 of hollow, generally cylindrical configuration and of smaller size than the lower portion 142. A lug 146 extends radially outwardly from the lower portion 142 at an upper end thereof adjacent a lower end of the upper portion 144. The lug 146 is seated within a recessed portion 148 extending from the aperture 124 in the lower leg 128 of the clevis 80 when the upper portion 144 thereof is inserted into the hollow interior of the lower portion 120 of the shaft 84. The recessed portion 148 is shown in FIG. 10. This prevents rotation of the cap 86 relative to the clevis 80 and the shaft 84. The cap 86 is secured in this position by a screw 150 which is inserted into the hollow interior of the lower portion 142 of the cap 86. The screw 150 extends through the hollow interior of the upper portion 144 of the cap 86 and engages the interior walls of a bore 152 extending upwardly from the hollow interior of the lower portion 120 of the shaft 84.

With the shaft 84 seated within the apertures 122 and 124 in the legs 126 and 128 of the clevis 80 and held in place by the cap 86, the lower tube 32 is securely joined to the vertical tube 76. A snug fit between the clevis 80 and the shaft 84 and cad 86 is further provided by the flange 138 and the lug 146. As a result, vertical flexure or movement of the lower tube 32 relative to the vertical tube 76 is negligible. The same is true of the lower tube 40 which is coupled to the vertical tube 76 by the lever 82. The leg 134 fits snugly around the shaft 84 and between the legs 126 and 128 of the clevis 80. Adjacent portions of the lever 82 fit snugly against the legs 126 and 128 of the clevis 80. In this manner vertical flexure of the lower tube 40 relative to the vertical tube 76 is negligible. This provides the hinged frame structure 12 with substantial rigidity.

The clevis 80, the lever 82, the shaft 84 and the cap 86 of FIG. 5 comprise the hinging apparatus for coupling the tubes 32 and 40 to the corner structure 34. Such apparatus is coupled to the lower end of the vertical tube 76. Similar apparatus is employed at the upper end of the vertical tube 76 to couple the tubes 30 and 38 of the back section 16 and the side section 18. As shown in FIG. 5 such hinging apparatus, which includes a clevis 154, a lever 156, a shaft 158 and a cap 159, is identical to the lower apparatus just described, except that it is inverted and the cap 159 thereof is shorter than the cap 86. The longer lower portion 142 of the lower cap 86 provides a foot for supporting the corner structure 34 and the joined portions of the hinged frame structure. However, in the case of the upper cap 159, there is no need for a long supporting foot. As in the case of the lower hinging apparatus, the clevis 154 is releasably coupled to the upper tube 30 and the lever 156 is releasably coupled to the upper tube 38. In this manner, the upper tube 38 is capable of undergoing pivoting rotation relative to the vertical tube 76, while the upper tube 30 is not.

At the opposite end of the back section 16 formed by the corner structure 36, the lower tube 32 of the back section 16 and the lower tube 52 of the side section 20 are coupled together by hinging apparatus similar to that shown in FIG. 5. Such hinging apparatus may permit the upper and lower tubes 50 and 52 of the side section 20 to undergo pivoting rotation relative to the corner structure 36 while preventing the upper and lower tubes 30 and 32 of the back section 16 from such rotation, or vice versa. The important thing from the standpoint of stability is that the single common vertical corner member be rotatable relative to only one of the two panel sections which it joins.

In similar fashion, the corner structure 42 which couples the side section 18 to the front section 22 may be configured so that the upper and lower tubes 44 and 46 of the front section 22 are capable of undergoing pivoting rotation relative to the corner structure 42 with the upper and lower tubes 38 and 40 of the side section 18 being fixed relative thereto, or vice versa. Likewise, at the corner structure 54 joining the front section 24 to the side section 20, the upper and lower tubes 56 and 58 of the front section 24 may be capable of undergoing pivoting rotation relative to the corner structure 54 with the upper and lower tubes 50 and 52 of the side section 20 being fixed, or vice versa.

Figure 6:
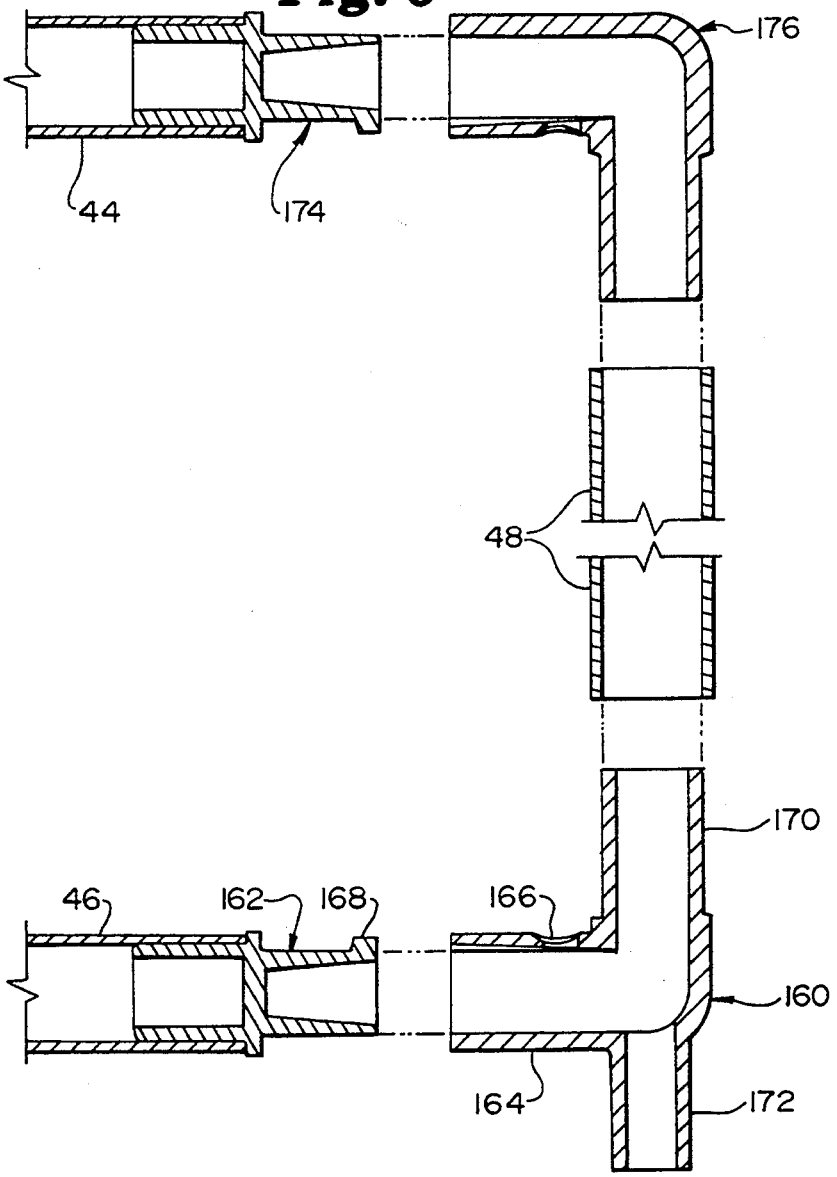
FIG. 6 is a sectional view of a different portion of the hinged frame structure of FIG. 2, showing the manner in which a terminating end of one of the front frame sections is coupled to the horizontal tubes thereof.

Within the front section 22, the lower tube 46 is coupled to the vertical tube 48 by an elbow 160, as shown in FIG. 6. A plug 162 like the plug 88 shown in FIG. 7 is secured within the hollow interior of the lower tube 46, such as by gluing, and is releasably secured within a horizontal portion 164 of the elbow 160. The horizontal portion 164 includes an aperture 166 for receiving a tab 168 on the plug 162, in the same manner that the aperture 106 in the clevis 80 receives the tab 104 of the plug 88, as previously described in connection with FIG. 5.

The elbow 160 extends through a right-angle bend between the horizontal portion 164 and a vertical portion 170. The vertical portion 170 is configured to fit within the hollow interior of the lower end of the vertical tube 48, where the vertical portion 170 is permanently secured such as by gluing. A further vertical portion 172 extends downwardly from the right-angle bend of the elbow 160 to form a supporting foot, much in the manner of the cap 86 shown in FIG. 5.

The upper tube 44 of the front section 22 is coupled to the upper end of the vertical tube 48 by apparatus similar to that shown in FIG. 6, except that such apparatus is inverted and has no vertical portion 172. A plug 174 similar to the plug 162 is employed to releasably couple the upper tube 144 to an elbow 176 within such corner structure. The elbow 176 extends into an upper end of the vertical tube 48, where it is permanently secured such as by gluing. The upper and lower tubes 56 and 58 of the front section 24 are coupled to the vertical tube 60 in similar fashion.

It will be appreciated that hinging apparatus such as that shown in FIG. 5 combines with the upper and lower tubes releasably coupled thereto to provide a hinged frame structure 12 which is substantially rigid and which is capable of supporting a substantial amount of weight and resisting a substantial amount of external force. At the same time, such hinged frame structure 12 is relatively lightweight and of simple and economical construction. The pivoting movement permitted between the vertical tube of each corner structure and one of the adjoining frame sections provides at least 180° of hinging movement between the adjoining frame sections, so that the hinged frame structure 12 can be placed in a variety of different configurations. At the same time, the hinged frame structure 12 is easily disassembled for transport or storage. The upper and lower tubes of the various frame sections are released from the corner structures using the plugs such as the plug 88 shown in FIG. 7, in the manner previously described. With the panels 14 removed from the children's play structure 10, the hinged frame structure 12 can be disassembled into a plurality of elongated sections.

While the invention has been particularly shown and described with reference to a preferred embodiment thereof, it will be understood by those skilled in the art that changes in form and details may be made therein without departing from the spirit and scope of the invention.

We claim:

1. Hinging apparatus for coupling opposite first and second generally horizontal beams to a generally vertical corner member comprising:

a clevis having a pair of legs extending therefrom with each of the legs having an aperture therein;

means for releasably and nonrotatably coupling the clevis to the first beam;

a lever having a leg extending therefrom with an aperture therein, the leg being disposed between the pair of legs of the clevis;

means for releasably and nonrotatably coupling the lever to the second beam;

a shaft coupled to the vertical corner member and extending through the apertures in the pair of legs of the clevis and the aperture in the leg of the lever; and a cap coupled to the shaft on an opposite side of the clevis and the lever from the vertical corner member.

2. Hinging apparatus in accordance with claim 1, wherein the clevis has a portion thereof with a hollow interior having an aperture extending through a wall thereof and the means for releasably coupling the clevis to the first beam comprises a plug mounted in an end of the first beam and having an end portion for removable insertion in the hollow interior of the clevis and having a resilient retainer for engaging the aperture in the wall of the clevis to releasably couple the end of the plug in the hollow interior of the clevis.

3. Hinging apparatus in accordance with claim 2, wherein the lever has a portion thereof with a hollow interior having an aperture extending through a wall thereof and the means for releasably coupling the lever to the second beam comprises a second plug mounted in an end of the second beam and having an end portion for removable insertion in the hollow interior of the lever and having a resilient retainer for engaging the aperture in the wall of the lever to releasably couple the end of the second plug in the hollow interior of the lever.

4. Hinging apparatus in accordance with claim 1, wherein the shaft is non-rotatably disposed within the clevis by an outstanding lug on the side thereof disposed within a recessed portion at a side of the aperture in a first one of the pair of legs.

5. Hinging apparatus in accordance with claim 4, wherein the cap is non-rotatably disposed within the clevis by an outstanding lug on the side thereof disposed within a recessed portion at a side of the aperture in a second one of the pair of legs.

6. The hinging apparatus according to claim 1, wherein said cap comprises a unitary body.

7. The hinging apparatus according to claim 1, wherein said shaft is unitary and generally cylindrical.

8. Hinging apparatus for coupling opposite first and second generally horizontal beams to a generally vertical corner member comprising:

a clevis having a pair of legs extending therefrom with each of the legs having an aperture therein, wherein the clevis has a portion thereof with a hollow interior having an aperture extending through a wall thereof;

means for releasably coupling the clevis to the first beam comprising a plug mounted in an end of the first beam and having an end portion for removable insertion in the hollow interior of the clevis and having a resilient retainer for engaging the aperture in the wall of the clevis to releasably couple the end of the plug in the hollow interior of the clevis;

a lever having a leg extending therefrom with an aperture therein, the leg being disposed between the pair of legs of the clevis, wherein the lever has a portion thereof with a hollow interior having an aperture extending through a wall thereof;

means for releasably coupling the lever to the second beam comprising a second plug mounted in an end of the second beam and having an end portion removable insertion in the hollow interior of the lever and having a resilient retainer for engaging the aperture in the wall of the lever to releasably couple the end of the second plug in the hollow interior of the lever;

a shaft coupled to the vertical comer member and extending through the apertures in the pair of legs of the clevis and the aperture in the leg of the lever;

a cap coupled to the shaft on an opposite side of the clevis and the lever from the vertical corner member;

wherein the first and second beams comprise hollow tubes and the first-mentioned plug and the second mentioned-plug each have a portion disposed within and glued to the tubes comprising the first and second beams, respectively.

9. The hinging apparatus according to claim 8, wherein the portion of said first and second mentioned plugs disposed within said tubes is generally cylindrical.

10. The hinging apparatus according to claim 9, wherein the end portion of said first and second mentioned plugs is tapered, and said plugs include a generally cylindrical flange seat between said generally cylindrical portion and tapered portion.

11. The hinging apparatus according to claim 10, wherein a longitudinal flange extends along the tapered end portion of said plugs for maintaining proper orientation of said resilient retainer associated with each plug.

12. Hinging apparatus for coupling opposite first and second generally horizontal beams to a generally vertical corner member comprising:

a clevis having a pair of legs extending therefrom with each of the legs having an aperture therein;

means for releasably coupling the clevis to the first beam;

a lever having a leg extending therefrom with an aperture therein, the leg being disposed between the pair of legs of the clevis;

means for releasably coupling the lever to the second beam;

a shaft coupled to the vertical comer member and extending through the apertures in the pair of legs of the clevis and the aperture in the leg of the lever wherein the shaft is non-rotatably disposed within the clevis by a lug on the side thereof disposed within a recessed portion at a side of the aperture in a first one of the pair of legs; and a cap coupled to the shaft on an opposite side of the clevis and the lever from the vertical comer member, wherein the cap is non-rotatably disposed within the clevis by a lug on the side thereof disposed within a recessed portion at a side of the aperture in a second one of the pair of legs and is coupled to the shaft by a screw extending through an aperture in the interior of the cap and into an aperture in the interior of the shaft.

13. Hinging apparatus in accordance with claim 12, wherein the corner member comprises a hollow tube and the shaft has a portion thereof opposite the clevis extending into and glued within the hollow tube.

* * * * *